United States Patent [19]

Holt

[11] Patent Number: 5,056,214

[45] Date of Patent: Oct. 15, 1991

[54] METHOD OF MAKING A MOLDED TRANSFORMER ENCLOSURE

[75] Inventor: Gary E. Holt, Holland, Mich.

[73] Assignee: Mark IV Industries, Inc, Amherst, N.Y.

[21] Appl. No.: 452,786

[22] Filed: Dec. 19, 1989

[51] Int. Cl.[5] ..... H01F 7/06

[52] U.S. Cl. ..... 29/602.1; 264/272.15; 264/272.19; 336/96

[58] Field of Search ..... 29/605, 606, 602.1, 29/609; 336/96; 264/272.15, 272.19

[56] References Cited

U.S. PATENT DOCUMENTS 2,731,607 5/1954 Gould et al. .
4,179,796 12/1979 Allen ..... 264/272.19 X
4,199,743 4/1980 Martincic .
4,225,839 9/1980 Martincic .
4,333,900 6/1982 Carey .
4,460,883 7/1984 Van Der Hoek et al. .
4,586,016 4/1986 Rilly et al. ..... 264/272.19 X
4,745,677 5/1988 Shichi .
4,763,095 8/1988 Bradt .

*Primary Examiner*—Carl E. Hall
*Attorney, Agent, or Firm*—Varnum, Riddering, Schmidt & Howlett

[57] ABSTRACT

A method of making an insulating enclosure (114) for a low resistance welding transformer (110) comprises assembling primary (116) and secondary (118) coils and a steel core (120) into a conventional inductive subassembly (112) having primary (122) and secondary (124) coil leads; placing the subassembly (112) into a mold (140) having stubs (164) projecting inwardly of the mold (140) in predisposed positions; and filling the mold (140) with an epoxy resin to sealingly encapsulate the subassembly (112) and provide premolded apertures (136) through the resulting enclosure (114). The epoxy resin includes equal parts of a nonfoaming, thermal-set epoxy and an aluminum oxide filler.

24 Claims, 3 Drawing Sheets

METHOD OF MAKING A MOLDED TRANSFORMER ENCLOSURE

BACKGROUND OF THE INVENTION

1. Field of the Invention

This invention relates generally to the construction of induction transformers and, more particularly, to a resistance welding transformer encased in a molded plastic enclosure.

2. Description of the Related Art

Transformers of the resistance welding type, that is, transformers having a low-voltage, high-amperage current output are commonly associated with industrial welding guns used in the automotive and white goods industries. In a typical application, a welding gun comprises a pair of pincerlike welding arms between which are positioned a pair of sheet metal surfaces that are to be welded together. The pincer arms are engaged with the metal surfaces, and a low-voltage, high-amperage current is passed between the arms to spot weld the sheet metal surfaces to each other. The resistance welding transformer typically reduces the voltage, for example, from 440 volts to approximately 25 volts.

Several types of such welding transformers are in conventional use. A fixed transformer is mounted to a plate or a platform and is electrically connected to the welding arms by flexible conduit. In an alternative arrangement, the transformer may be integrally mounted to the welding gun and electrically connected to the welding arms by a conductive bus. In a third arrangement, transformers of the type known as portable gun transformers may be utilized. These transformers are similar to the integrally mounted transformers except that the welding gun is more or less portable relative to the integrally mounted type.

The resistance welding transformers presently known are of generally similar construction and typically comprise a subassembly encased within an enclosure. The subassembly comprises a wound copper primary coil, a water-cooled secondary coil that is thermally and electrically insulated from the primary coil, and a steel core surrounding the coils to provide the magnetic field which induces the flow of electrical current in the secondary coil. The enclosure typically comprises a pair of end caps or body clamps mounted to the end portions of the subassembly and a sheet metal skin intermediate the end caps. A plurality of threaded rods are engaged with aligned apertures provided in the end caps and secure the end caps and the skin to form a complete enclosure. The enclosure may be filled with an encapsulant such as epoxy to prevent the intrusion of water and other contaminants. The end caps are provided with a plurality of tapped holes for mounting the transformer to the welding gun. Electrical contacts or leads are electrically connected to the secondary coils and extend through the enclosure to provide current at the reduced voltage.

The welding gun typically includes a plurality of threaded lugs fixed in predetermined locations which engage the threaded holes in the transformer end caps. Since the position of the mounting lugs is fixed and predetermined, it is essential that the threaded holes in the transformer end caps be precisely oriented so that the transformer may be mounted to the welding gun with the contacts in proper position to engage a bus that conducts the current to the pincer arms.

Sometimes, after the transformer has been assembled, the holes in the end caps are hand-tapped after carefully measuring the position of the mounting lugs on the welding gun to ensure proper alignment of the holes with the lugs. Obviously, this is a time-consuming, labor-intensive process requiring considerable precision and skill. Also, if the opposed end caps are not rigidly secured relative to each other, they may shift and disturb the alignment of the tap holes in one end cap relative to the tapped holes in the paired end cap. Relatedly, if the transformer should ever require disassembly, precise repositioning of the end caps relative to each other is difficult to achieve. Alternatively, elongated holes are sometimes provided in the gun to permit positional adjustment of the transformer with respect to the bus. However, with continuous cycling of the gun, opportunity still exists for the transformer to lose satisfactory contact with the bus. In general, then, it can be seen that with enclosures used in the welding transformers presently known, it is difficult to maintain the dimensional integrity of the means for mounting the transformer to the welding gun.

Thus, there is a need for a housing that does not require accurate and repetitive measurements for the tapped holes in each transformer that is assembled. It would be desirable to have a housing in which the tapped holes were prepositioned so as to be aligned with the mounting lugs on a welding gun. It would also be desirable to have a transformer enclosure that is more or less integral, thereby eliminating the multiple-piece constructions presently known and their tendency to disrupt the dimensional integrity of the mounting means.

The enclosures that are presently known for resistance welding transformers are not electrically insulated and therefore require a separate ground to provide a structure that meets work place safety requirements. It would simplify assembly and installation if the enclosure could be formed of a non-conductive material of high dielectric strength, and also be thermally stable over a wide range of operating temperatures. It is known to encapsulate resistance welding transformers with epoxy. But, the materials presently used have inadequate heat transfer capabilities and insufficient strength to structurally maintain an integral enclosure. In an unrelated field, small current transformers are frequently encapsulated with an injection-molded plastic material. The materials used for current transformers, however, are inapplicable to the rigorous operating conditions of resistance transformers. Accordingly, in constructing an enclosure for resistance welding transformers, there is a need for a material that can withstand the high current, low voltage, wide-ranging temperature gradients, and physical stresses typically present in resistance welding transformer operations.

SUMMARY OF THE INVENTION

The invention provides a method of constructing a resistance welding transformer which solves the problems of the prior art. The method is directed to resistance welding transformers of the type having at least two primary coils with at least one secondary coil sandwiched therebetween. In this type, the primary coils have leads to electrically connect to a source of current, the secondary coil is hollow to permit cooling fluid to pass through it, and also has leads to conduct current therefrom.

The method comprises generally the steps of assembling primary and secondary coils and a steel core in a manner to create an inductive subassembly having primary coil leads and secondary coil leads;

providing a mold having separable wall portions, each wall portion having at least one stub projecting inwardly of the mold, with the stubs being adapted to align with and contact each other when the mold is closed;

seating the subassembly on a mounting means between the separable wall portions;

interengaging the separable wall portions to close the mold around the subassembly; and filling the mold with an epoxy resin to sealingly encapsulate the subassembly except for the primary and secondary coil leads.

In another aspect of the invention, the epoxy resin is a two-part, thermal-set epoxy having a high dielectric strength and high thermal stability over a wide range of operating temperatures. Preferably, the primary coil leads are on a first end of the subassembly, and the secondary coil leads are on a second end of the subassembly. It is the second end of the subassembly that is preferably mounted in the mounting means. The mounting means can comprise a block adapted to receive the secondary coil leads.

In another aspect of the invention, each separable wall portion defines one half of the external shape of the transformer. Typically, each separable wall portion is generally C-shaped, with a plate secured to a lower portion thereof. The plate has notches complementary in shape to the secondary coil leads so that the notches on the plates of the oppositely disposed wall portions form apertures through which the secondary coil leads project when the mold is closed. Preferably, a gasket is placed around each secondary coil lead so as to be in registry with each aperture formed when the mold is closed.

In yet another aspect of the invention, the entire subassembly can be impregnated with an insulating epoxy under vacuum prior to being placed in the mold.

BRIEF DESCRIPTION OF THE DRAWINGS

The invention will be now be described with reference to the drawings in which.

DETAILED DESCRIPTION OF THE PREFERRED EMBODIMENTS

Figure 1A:
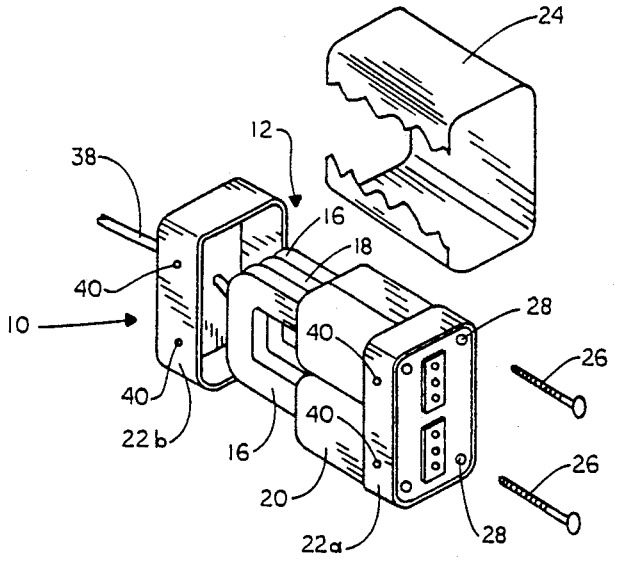
FIG. 1a (PRIOR ART)
FIG. 1A is a partially exploded perspective view of a resistance welding transformer of the prior art.

Turning now to the drawings, FIG. 1 illustrates a prior-art resistance welding transformer 10 of a type generally referred to as an integral gun transformer, that is, a transformer that is directly mounted to a pad on a welding gun apparatus, as explained more fully below. The transformer 10 comprises an internal subassembly 12 and a housing 14 that surrounds and encases the subassembly 12. As is conventional in the resistance welding transformer art, the subassembly 12 includes a pair of wound copper primary coils 16 and a fabricated copper secondary coil 18 sandwiched between the primary coils. It will be understood that the number of primary and secondary coils 16, 18 can be varied, the number being utilized depending on the amount of current needed and the desired voltage reduction for the output current, as explained more fully below. An insulating material (not shown separately in the drawings) is interposed between the primary and secondary coils 16, 18 to electrically separate them. Typically, insulation (not shown separately in the drawings) is also provided between the individual turns of the coils 16, 18. Further, the secondary coil 18 is generally provided with a hollow construction such that water or other coolant may be circulated internally of the coil to cool the same.

The internal subassembly 12 further comprises a plurality of steel cores 20 that may be of either the stacked or wound type. The cores 20 may be formed of two halves of generally U-shaped configuration, the legs of a pair of U-shaped cores being engaged to surround the primary and secondary coils 16, 18 at the bights of the U-shaped members.

The housing 14 comprises end caps or body clamps 22, a skin 24 and a plurality of threaded connection rods 26. The body clamps 22 are of generally open, boxlike construction and are received over the end portions of the primary and secondary coils 16, 18 and the surrounding cores 20. The skin 24 may or may not be included depending upon the particular application, and is positioned intermediate the body clamps 22 and surrounds the primary and secondary coils 16, 18 and the cores 20. An epoxy seal (not shown separately in the drawings) can be provided between the end caps 22 to prevent the intrusion of contaminants such as water and oil. The end caps **22*a*, 22*b* are provided with a plurality of threaded apertures 28 which are aligned and which receive the threaded connection rods 26** to secure the end caps and the skin.

Typically, the interior of the housing 14 is filled with a two-part, thermal-set epoxy encapsulant, the principal purpose of which is to resist the intrusion of water. The end cap **22*a* includes openings 30 and which receive secondary leads 32 and water ports 34. Threaded apertures 36 may also be located in the leads 32 to facilitate secure, tight connections. The end cap 22*b* includes openings that receive primary leads 38. The primary leads may be a simple flexible conduit as illustrated, or a fixed connector. The secondary leads 32 are electrically connected to the secondary coil 18 and the primary leads 38 are electrically connected to the primary coils 16. The water ports 34 are in open communication with the hollow interior of the secondary coil 18. Although the leads 32, 38 and the water ports 34** may extend from a single end cap, it is desirable that the primary leads and the secondary leads be separated in order to reduce the risk of arcing between the leads because of the substantial difference in potential caused by the voltage reduction in the secondary coil, as explained more fully below.

The end caps **22*a*, 22*b* are further provided with a plurality of tapped holes 40. The tapped holes 40 serve as a truss to mount the transformer 10** to a welding gun.

The operation of transformer 10 is conventional. In a typical application, single phase 440-volt, 60-hz current is supplied from a source (not shown separately in the drawings) to the primary leads 38 and the primary coils 16. The presence of the steel cores 20 facilitates a magnetic field generated by the current flowing through the primary coil which induces an electric potential in the secondary coils 18 which, depending on the arrangement of the primary and secondary coils and the cores, is typically in the range of 3 to 25 volts. The relatively low-voltage output current is fed to the secondary leads 32 where it may be directed to a welding gun, for example.

Figure 2:
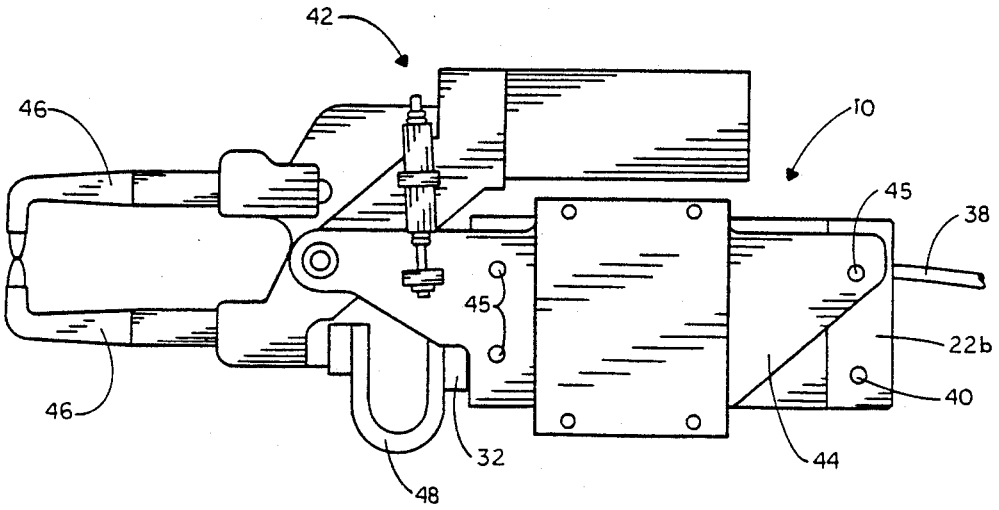
FIG. 2 is an elevational view of a welding gun incorporating a transformer made according to the prior art.

FIG. 2 is a plan view of a welding gun 42 that is adapted for use with the resistance welding transformer 10. The welding gun 42 includes a transformer mounting plate 44, a pair of welding arms 46, and an electrical bus 48 that electrically connects the welding a 46 to the transformer 10. The transformer 10 is mounted to the transformer mounting plate 44, threaded lugs 45 on mounting plate registering with the tapped holes 40 in the body clamps **22*a*, 22*b*. The bus 48 is electrically connected to secondary leads 32 to provide a relatively low-voltage, high-current output to the welding arms 46 of the welding gun 42**.

Figure 1B:
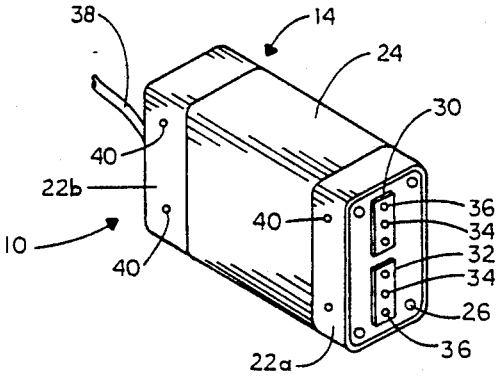
FIG. 1b (PRIOR ART)
FIG. 1B is a perspective view of the fully assembled transformer of FIG. 1A.

As previously noted, transformers of the type shown in FIGS. 1A and 1B suffer from several deficiencies. For example, because the mounting lugs 45 on the transformer mounting plate 44 are prepositioned, the holes 40 in the end caps **22*a*, 22*b* must be accurately tapped so that they will be oriented to engage the mounting lugs. Similarly, the relative positions of the end caps 22*a*, 22*b* must be accurately maintained so that the tapped holes 40 carried thereby remain aligned with the mounting lugs 45 on the transformer mounting plate 44. Thus, it is frequently difficult to maintain the dimensional integrity between the end caps 22*a*, 22*b* and the tapped holes 40 therein relative to the fixed position of the mounting lugs 45 on the transformer mounting plate 44. Further, it is critical that the secondary leads 32 maintain contact with the bus 48 so that current is conducted to the welding arms 46. Thus, the transformer 10 must also maintain dimensional integrity with respect to the bus 48. Also, precision placement of the tapped holes 40 subsequent to the assembly of the transformer 10 is a time-consuming, labor-intensive and cumbersome process. As well, it is a laborious procedure to separately assemble the end caps 22*a*, 22*b* and the skin 24 and to insulate the same from the primary coils 16**.

Figure 3:
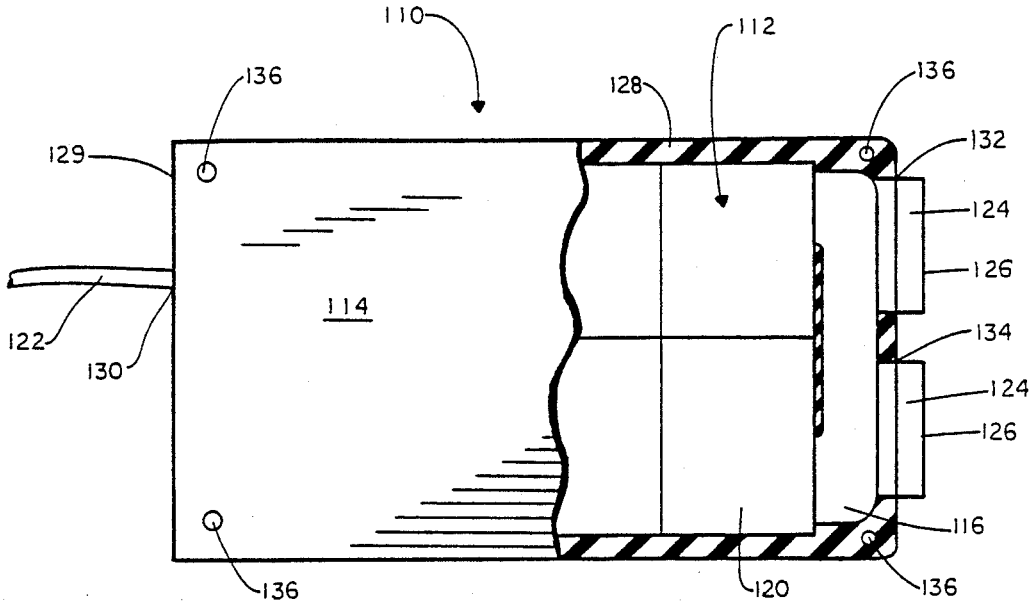
FIG. 3 is an elevational view of a transformer according to the invention with a portion of the enclosure broken away to show the internal subassembly of the transformer more clearly.
Figure 4:
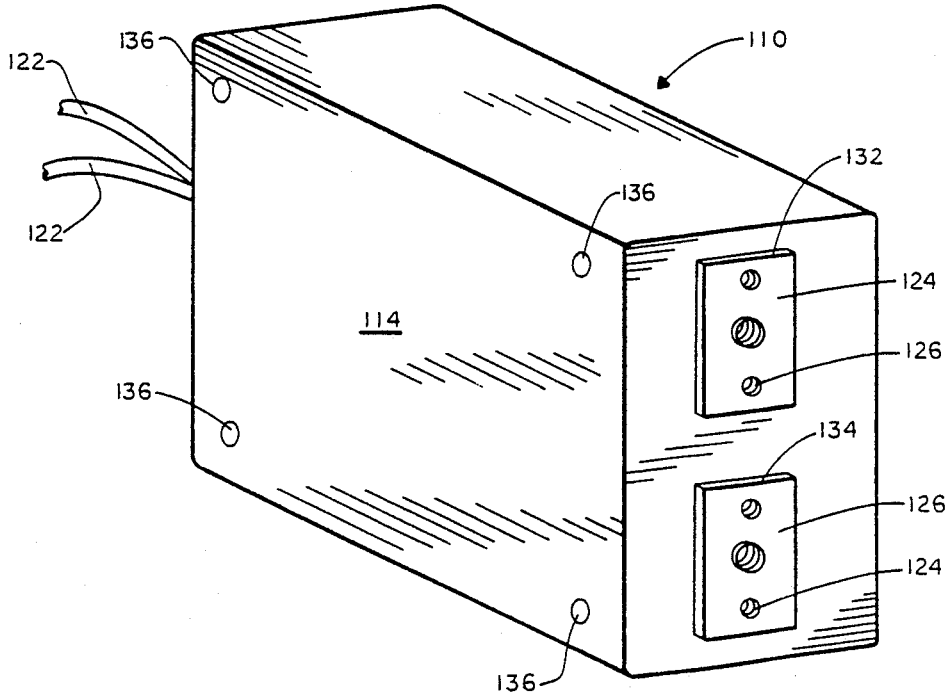
FIG. 4 is a perspective view of the transformer of FIG. 3.
Figure 5:
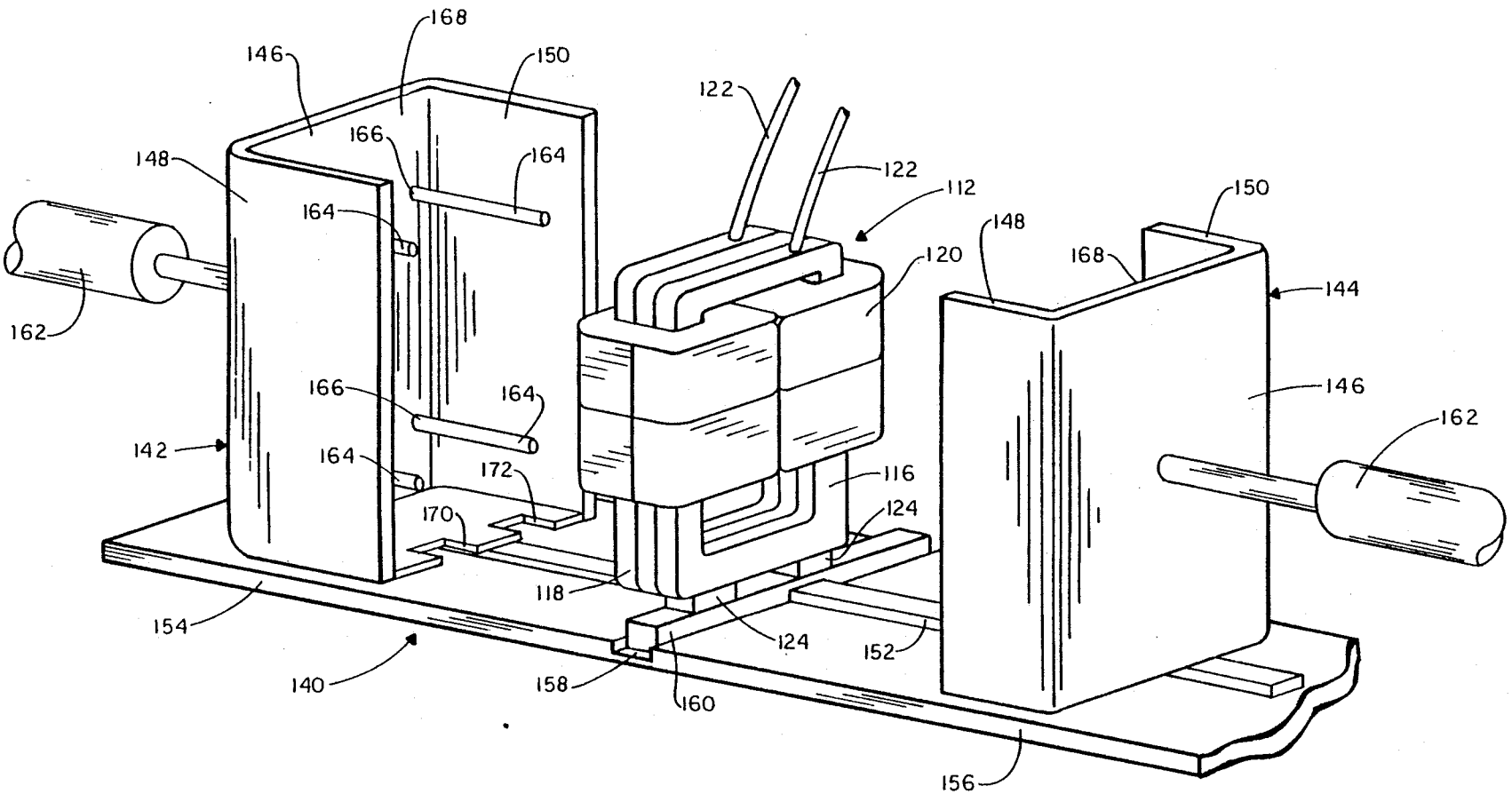
FIG. 5 is a perspective view of a mold for making an integral molded enclosure for a transformer according to the invention and showing the internal subassembly of the transformer positioned within the mold.

Turning now to FIGS. 3–5 illustrating the invention, reference numerals analogous to those used to illustrate the transformer of FIGS. 1A and 1B have been increased by 100. This invention relates to a transformer 110 of the resistance welding type having an internal subassembly 112 and a housing 114 which surrounds and protects the internal subassembly. As will become apparent below, the housing 114 is significantly differently from the housing 14. The housing 114 provides an integral molded plastic enclosure having prepositioned apertures formed therein, as explained more fully below.

The internal subassembly 112 includes primary coils 116 formed from wound, annealed copper ribbon insulated with either tape or epoxy. Interposed between the primary coils is a fabricated copper secondary coil having a water passage (not shown separately in the drawings) formed therein to dissipate heat from the coils and cool the same. The subassembly 112 further includes steel cores 120 of the wound or stacked type. Further associated with the internal subassembly 112 are primary leads 122, secondary leads 124 and water ports 126.

In function and operation, the transformer 110 is substantially similar to the transformer 10. That is, the transformer 110 may be mounted to a welding gun 42 as shown in FIG. 2 and secured to the transformer mounting plate 44 in a conventional manner. The primary leads 122 of the subassembly 112 are conductively connected to a power source, typically a source having a 440-volt, 60-hertz, single-phase output. The primary leads are, in turn, electrically connected to the primary coil 116 and the flow of current therethrough causes the steel cores 120 to maintain a magnetic flux which induces a current to flow in the secondary coil 118. The secondary coil 118 is, in turn, conductively connected to the secondary leads 124. If installed in a welding gun, the secondary leads 124 are electrically connected to the bus 48 of the welding gun 42 thereby providing a source of low voltage and high current to the welding arms 46 in order to spot-weld sheet metal surfaces and the like. The water ports 126 are in open communication with the internal water passageway of the secondary coil 118 and the flow of water therethrough dissipates heat and cools the coils.

As noted hereinabove, the housing 114 of the transformer 110 is a significantly different and novel construction relative to the housing 14 of the presently known transformer 10. The housing 114 comprises an integral molded plastic enclosure 128 having formed in one end 129 thereof an opening 130 that is adapted to receive the primary leads 122 and having formed in an opposite end 131 thereof openings 132 and 134 which are adapted to receive, respectively, the secondary leads 124 and the water ports 126. Also formed in the enclosure 128 are a plurality of premolded apertures 136 which are adapted to engage the mounting lugs 45 on the transformer mounting plate 44 of the welding gun 42. Because the apertures 136 are premolded into the enclosure 128, it is not necessary to carefully measure the position of the holes and provide the same by a labor-intensive, time-consuming hand operation as is required for those transformers that are presently known.

As best shown in FIG. 5, a mold 140 for manufacturing the housing 114 comprises a pair of complementary mold halves 142 and 144. Each mold half 142, 144 comprises a main wall 146 and a pair of side walls 148 and 150 which extend in parallel, spaced-apart relation from opposite ends of the main wall. Each mold half 142, 144 has a bottom plate 151 which slidably mounts to a rail 152 that is supported at opposite ends thereof by base plates 154 and 156. The base plates 154, 156 are spaced slightly apart to provide a channel 158 therebetween. An assembly mounting plate 160 is positioned within the channel 158 and includes a notch 161 adapted to engage the rail 152 such that the plate 160 straddles the rail.

As shown in FIG. 5, the internal subassembly 112 of the transformer 110 is seated on the assembly mounting plate 160 and may be secured thereto with lugs, bolts or other mechanical fasteners (not shown separately in the drawings). Preferably, the subassembly 112 is seated on the mounting plate 160 with the secondary leads 124 contacting or secured directly to the mounting plate 160. The primary leads 122 thus project upwardly from the mold. In operation, the mold halves 142, 144 slidably reciprocate along the rail 152, each mold half being driven by a ram 162 that can be manually or hydraulically operated. It can be seen that each mold half 142, 144 further includes a plurality of stubs 164 in the form of solid dowels or rods. Each stub 164 is mounted at an end 166 thereof to an inside surface 168 of the mold main wall 146. Each stub in mold half 142 is adapted to align with and contact a corresponding stub 164 in mold half 144 when the mold 140 is closed. The stubs are further adapted to be adjustably positioned anywhere in the mold that a mounting aperture in the resulting enclosure is desired. It will be understood that the stubs 164 need not necessarily contact each other if it is desired that mounting holes 136 in the housing 114 not extend all the way through the housing. The bottom wall 151 of each mold half 142, 144 includes a pair of recessed portions 170, 172.

In operation, when the two mold halves 142, 144 are brought together, the side walls 148 and 150 of each mold half engage a do the stubs 164 which are aligned. Further, the recessed portions 170 and 172 in the bottom wall 151 of mold half 142 are aligned with corresponding recessed portions (not shown) in mold half 144, and, when engaged, provide the openings 130 and 132 in the enclosure 128 for the secondary leads 124. The enclosure 128 is formed by filling the open-topped mold 140 with a thermal-set material such as epoxy. Although many thermal-set epoxies may be used, it has been found that a compound containing a nonfoaming, thermal-set polymer such as polyurethane with appropriate crystallizers as, for example, the substance manufactured under the name Alumalite TM Super-light Liquid, commercially marketed by Coating Plastics, Kalamazoo, Mich. 49007, is preferred because it evidences good thermal conductivity, maintains structural integrity and has low shrinkage over a wide range of operating temperatures, for example, −20° F. to 300° F. Any material thus used should also be easily moldable, have high-dielectric strength and be moisture and flame resistant.

In order to provide a more uniform cure rate with less bubbles, it has been found desirable to add a filler such as aluminum oxide ($Al_2O_3$) to enhance the performance characteristics of the epoxy. The aluminum oxide improves the dissipation of heat through the enclosure 128 thereby increasing the life of the transformer. In experiments where the enclosure 128 was molded from Alumalite without the aluminum oxide filler, a temperature gradient on the order of approximately 40° C. between opposite ends of the enclosure was observed due to the tremendous heat generated at the end of the enclosure having the secondary leads. When aluminum oxide filler was added to the Alumalite, the temperature gradient was reduced to approximately 10° C. Table 1 shows the relative heat transfer coefficients for different fillers used with equal parts Alumalite. It will be evident that some fillers, although providing a high heat transfer coefficient, are unacceptable because they are conductive, thus reducing the dielectric strength of the material.

| Filler | Heat Transfer Coefficient (in K-cal/Hr/m/C.°) |
|---|---|
| Aluminum Nitride | .2836 |
| Aluminum Oxide $Al_2O_3$ | .3266 |
| Micro-alumina | .2962 |
| *Aluminum powder | .3730 |
| None | .1078 |
| *Black sand (Iron) | .2732 |
| Silica sand | .2285 |

-continued

| Filler | Heat Transfer Coefficient (in K-cal/Hr/m/C.°) |
|---|---|
| *Ferrite | .2317 |
| Micro balloons (glass) | .1096 |
| ¼" strand glass fibers | .1198 |
| Sodium Sulfide | .1967 |

*Electrically conductive

A further advantage of the use of aluminum oxide filler is that there is no need to preheat the mold in order to minimize formation of bubbles and obtain a uniform cure rate.

Once the epoxy with filler has been added to the mold 130, it is allowed to cure for approximately five minutes under conditions of ambient temperature and pressure. After the epoxy has set, the mold halves 142, 144 are separated from the transformer 110 and the integrally molded enclosure is removed therefrom. It has been found that the use of a mold-release spray facilitates removal of the transformer 110 from the mold 140. The mold 140 may be formed of anodized aluminum although steel is preferred.

The presence of the stubs 164 in the mold 140 provides the premolded apertures 136 which extend entirely through the molded enclosure 128. The transformer 110 can then be mounted to the transformer mounting plate 44 associated with the welding gun 42 by registering the molded lugs on the plate to premolded apertures 136. If desired, tapped inserts may be pressed into the apertures 136 or mechanically formed therein because the apertures 136 are directly molded into the enclosure 128. However, there is generally no need for the time-consuming, labor-intensive end tapping operation that is required for those transformers that are presently known. Further, because the molded enclosure is an integral member formed of an epoxy that exhibits structural integrity and low shrinkage over a wide range of operating temperatures, the dimensional integrity of the housing 114 and the position of the premolded apertures 136 relative to each other remain relatively constant.

Reasonable variations or modifications are possible within the spirit of the foregoing specification and drawings without departing from the scope of the invention which is defined in the accompanying claims.

The embodiments of the invention in which an exclusive property or privilege is claimed are defined as follows:

1. A method of constructing an induction transformer having at least one primary coil and at least one secondary coil, said primary coil having leads to electrically connect to a source of current, and said secondary coil having leads to conduct current therefrom,; comprising:

assembling primary and secondary coils and means to maintain a magnetic flux density therearound in a manner to create an inductive subassembly having primary coil leads extending from the primary coil and secondary coil leads extending from the secondary coil;

providing a mold having a wall portion, said wall portion having at least one stub projecting inwardly of the mold;

seating the subassembly on a mounting means adjacent the wall portion;

filling the mold with an epoxy resin to sealingly encapsulate the subassembly except for the primary and secondary coil leads; and allowing the epoxy resin to harden, thereby providing a molded enclosure about said subassembly, said molded enclosure having at least one premolded mounting hole integrally formed by the at least one stub for mounting the transformer to a support.

2. A method according to claim 1 wherein the epoxy resin comprises equal parts of aluminum oxide and a nonfoaming, thermal-set epoxy, wherein said resin has a high dielectric strength and high thermal stability over a wide range of operating temperatures and so that the resin will maintain structural integrity when current at high amperage and low voltage is supplied to the transformer.

3. A method according to claim 2 wherein the nonfoaming, thermal-set epoxy includes a polyurethane polymer.

4. A method according to claim 1 wherein the primary coil leads are on a first end of the subassembly and the secondary coil leads are on a second end of the subassembly.

5. A method according to claim 4 wherein the second end of the subassembly is mounted on the mounting means.

6. A method according to claim 5 wherein the mounting means comprises a block adapted to receive the secondary coil leads.

7. A method according to claim 1 wherein said mold has separable wall portions and each said wall portion has at least one stub projecting inwardly of the mold.

8. A method according to claim 7 wherein the primary coil leads are on a first end of the subassembly and the secondary coil leads are on a second end of the subassembly.

9. A method according to claim 8 wherein the second end of the subassembly is mounted on the mounting means.

10. A method according to claim 9 wherein the mounting means comprises a block adapted to receive the secondary coil leads.

11. A method according to claim 7 wherein each said separable wall portion defines one half of the external shape of the transformer.

12. A method according to claim 11 wherein each of said separable wall portions is generally C-shaped, with a plate secured to a lower portion thereof.

13. A method according to claim 12 wherein said plate has notches complementary in shape to the secondary coil leads so that the notches on the plates of the oppositely disposed wall portions form apertures through which the secondary coil leads project when the mold is closed.

14. A method according to claim 13 further comprising the step of placing a gasket around each secondary coil lead so as to be in registry with each aperture formed when the mold is closed.

15. A method according to claim 1 wherein the subassembly is impregnated with an insulating epoxy under vacuum prior to being placed in the mold.

16. A method according to claim 1 wherein the transformer has at least two primary coils with at least one secondary coil sandwiched therebetween, said secondary coil being hollow to permit cooling fluid to pass through it.

17. A method of constructing an induction transformer having at least one primary coil and at least one secondary coil, said primary coil having leads to electrically connect to a source of current, and said secondary coil having leads to conduct current therefrom, comprising:

assembling primary and secondary coils and means to maintain a flux density therearound in a manner to create an inductive subassembly having primary coil leads extending from the primary coil and secondary coil leads extending from the secondary coil;

providing a mold having separable wall portions, each wall portion having at least one stub projecting inwardly of the mold, with the stubs being adapted to align with and contact each other when the mold is closed;

seating the subassembly on a mounting means between the separable wall portions;

interengaging the separable wall portions to close the mold around the subassembly;

filling the mold with an epoxy resin to sealingly encapsulate the subassembly except for the primary and secondary coil leads; and allowing the epoxy resin to harden, thereby providing a molded enclosure about said subassembly, said molded enclosure having at least one premolded mounting hole integrally formed by the at least one stub for mounting the transformer to a support.

18. A method according to claim 17 wherein the stubs are adapted to align with and contact each other when the mold is closed.

19. A method according to claim 17 wherein the epoxy resin comprises equal parts of aluminum oxide and a nonfoaming, thermal-set epoxy having a high dielectric strength and high thermal stability over a wide range of operating temperatures.

20. A method according to claim 19 wherein the epoxy includes a polyurethane polymer.

21. A method of constructing an induction transformer having at least one primary coil and at least one secondary coil, said primary coil having leads to electrically connect to a source of current, and said secondary coil having leads to conduct current therefrom, comprising:

assembling primary and secondary coils and means to maintain a magnetic flux density therearound in a manner to create an inductive subassembly having primary coil leads extending from the primary coil and secondary coil leads extending from the secondary coil;

providing a mold having a wall portion, said wall portion having at least one stub projecting inwardly of the mold;

seating the subassembly adjacent the wall portion;

filling the mold with an epoxy resin formed of equal parts of aluminum oxide and a nonfoaming, thermal-set epoxy to sealingly encapsulate the subassembly except for the primary and secondary coil leads; and allowing the epoxy resin to harden, thereby providing a molded enclosure about said subassembly, said molded enclosure having at least one premolded mounting hole integrally formed by the at least one stub for mounting the transformer to a support.

22. A method of constructing an induction transformer having at least one primary coil and at least one secondary coil, said primary coil having leads to electrically connect to a source of current, and said secondary coil having leads to conduct current therefrom, comprising:

assembling primary and secondary coils and means to maintain a flux density therearound in a manner to create an inductive subassembly having primary coil leads extending from the primary coil and secondary coil leads extending from the secondary coil;

providing a mold having separable, generally C-shaped wall portions, each wall portion having at least one stub projecting inwardly of the mold, with the stubs being adapted to align with and contact each other when the mold is closed;

seating the subassembly on a plate disposed between the separable wall portions, said plate having apertures complementary in shape to the secondary coil leads so that the secondary coil leads project through the apertures when the mold is closed;

interengaging the separable wall portions to close the mold around the subassembly; and filling the mold with an epoxy resin to sealingly encapsulate the subassembly except for the primary and secondary coil leads.

23. A method according to claim 22 wherein the plate comprises two separable parts spaced from each other and mounted to the wall portions, each part having an edge with a notch formed therein complementary in shape to the secondary coil leads so that the notches on the parts will form the apertures when the parts are joined to form the plate.

24. A method according to claim 22 further comprising the step of placing a gasket around the secondary coil leads so as to be i registry with the apertures in the plate.

* * * * *